US011717039B2

(12) United States Patent
Howe

(10) Patent No.: US 11,717,039 B2
(45) Date of Patent: Aug. 8, 2023

(54) IMMOBILIZING SLEEP GARMENT ASSEMBLY

(71) Applicant: Nelson Howe, Denver, CO (US)

(72) Inventor: Nelson Howe, Denver, CO (US)

( * ) Notice: Subject to any disclaimer, the term of this patent is extended or adjusted under 35 U.S.C. 154(b) by 79 days.

(21) Appl. No.: 17/381,333

(22) Filed: Jul. 21, 2021

(65) Prior Publication Data

US 2023/0027785 A1 Jan. 26, 2023

(51) Int. Cl.
*A41D 13/12* (2006.01)
*A41D 1/04* (2006.01)

(52) U.S. Cl.
CPC ..... *A41D 13/1245* (2013.01); *A41D 1/04* (2013.01)

(58) Field of Classification Search
CPC .... A41D 1/04; A41D 13/1245; A41D 13/007; A41D 13/0518; A41D 19/0041; A41D 9/02; A41D 9/025; A61F 5/3725; A61F 5/3746; A61F 5/373; A61F 5/3738
See application file for complete search history.

(56) References Cited

U.S. PATENT DOCUMENTS 3,038,166 A * 6/1962 Tobias ..... A41F 9/025 2/221
3,295,144 A * 1/1967 Mengers ..... A41F 9/02 2/237
4,100,620 A * 7/1978 Pecoraro ..... A41D 13/0518 2/463
4,578,824 A * 4/1986 Waldron ..... A41F 9/025 2/919
4,601,285 A * 7/1986 Whitchurch ..... A61F 5/3746 602/4
5,031,639 A * 7/1991 Wolfer ..... A61F 5/3723 128/869
5,095,894 A * 3/1992 Marble ..... A61F 5/3746 602/62
5,106,004 A * 4/1992 Nguyen ..... A41F 9/002 224/163
5,226,195 A * 7/1993 Pappas, Jr. ..... A41F 9/002 224/660
5,514,019 A * 5/1996 Smith ..... B63C 9/11 2/311
5,943,705 A * 8/1999 Sink ..... A41F 9/002 2/338

(Continued)

FOREIGN PATENT DOCUMENTS

WO WO2010120576 10/2010
WO WO-2010139084 A1 * 12/2010 ..... A61F 5/3746

*Primary Examiner* — Heather Mangine

(57) ABSTRACT

An immobilizing sleep garment assembly includes a vest is wearable on a user when the user is recovering from shoulder surgery. A plurality of chest mating members is each vertically oriented on the vest. A plurality of first straps is each disposed on the vest and a plurality of second straps is each of the second straps is disposed on the vest. Each of the first straps is releasably matable to a respective one of the second straps to secure the vest around the user's upper torso. A glove is provided that can be worn on a respective one of the user's hands. A glove mating member is coupled to the glove and the glove mating member releasably engages the chest mating members at a desired location on the plurality of chest mating members to restrain the user's arm for sleeping while recovering from the shoulder or arm surgery.

9 Claims, 5 Drawing Sheets

(56) References Cited

U.S. PATENT DOCUMENTS 5,987,644 A * 11/1999 Mengato ..... A41D 1/04 2/69
6,079,051 A * 6/2000 Whinston ..... A41D 13/0005 2/93
6,122,778 A * 9/2000 Cohen ..... A62B 35/0006 5/81.1 R
6,138,277 A * 10/2000 Gillen ..... A41D 13/015 2/463
6,336,908 B1 * 1/2002 Slautterback ..... A41F 9/002 2/312
6,406,449 B1 * 6/2002 Moore ..... A41D 13/1245 602/60
6,446,273 B1 * 9/2002 Gillen ..... A41D 13/0153 2/2.5
6,637,547 B1 * 10/2003 Wydner ..... A41D 13/0007 182/3
6,817,032 B2 11/2004 Hollander
6,936,021 B1 * 8/2005 Smith ..... A41D 13/1245 602/61
7,093,301 B1 * 8/2006 Moore, Jr. ..... A41D 13/0518 2/2.5
8,105,371 B1 * 1/2012 Giocondo, Jr. ..... A41D 1/04 607/108
8,454,544 B2 * 6/2013 Barnes ..... A61F 5/3753 602/19
10,537,460 B2 * 1/2020 Yao ..... A61F 5/373
2002/0156406 A1 * 10/2002 Moore ..... A41D 13/1245 602/4
2004/0000002 A1 * 1/2004 Hollander ..... A41B 9/06 2/69
2004/0250332 A1 * 12/2004 Tadin ..... A41D 27/20 2/94
2008/0216219 A1 * 9/2008 Desnoyers ..... A41D 13/0153 2/92
2009/0144876 A1 * 6/2009 Pena ..... A41D 13/0007 5/81.1 R
2010/0267525 A1 * 10/2010 Tanner ..... A41D 31/18 2/102
2012/0159694 A1 * 6/2012 Ploughman ..... A41F 9/002 2/338
2013/0042386 A1 * 2/2013 Montgomery ..... A47D 15/008 2/102
2013/0167286 A1 * 7/2013 Hudson ..... A41F 9/00 2/300
2014/0013482 A1 * 1/2014 DiBernardo ..... A41D 1/04 2/102
2015/0305420 A1 * 10/2015 Daniels ..... A41D 1/02 2/93
2015/0351471 A1 * 12/2015 Donovan ..... A41D 19/002 2/160
2016/0101822 A1 * 4/2016 Schvey ..... B63C 9/11 2/310
2016/0187102 A1 * 6/2016 Kuo ..... B32B 7/05 2/2.5
2016/0278963 A1 * 9/2016 Webster ..... A61F 5/05858
2016/0295937 A1 * 10/2016 Harrington ..... A41D 13/0125
2016/0316837 A1 * 11/2016 Acton ..... A41F 9/00
2017/0049166 A1 * 2/2017 Shorter ..... A41D 13/1245
2017/0082404 A1 * 3/2017 Blauer ..... F41H 1/02
2018/0207017 A1 * 7/2018 George ..... A41B 1/08
2019/0038502 A1 * 2/2019 Shockley, Jr. ..... A61H 23/02
2019/0098942 A1 * 4/2019 Matsuo ..... A61F 5/02
2019/0133214 A1 * 5/2019 Brown ..... A41D 27/02
2019/0166926 A1 * 6/2019 Doroski ..... A61G 7/1038
2019/0298565 A1 * 10/2019 Jacobs ..... A41D 27/20
2020/0281288 A1 * 9/2020 Eddy ..... A61F 5/3723
2020/0315268 A1 * 10/2020 Marks ..... B62J 27/00
2021/0085506 A1 * 3/2021 Wonnacott ..... A41D 13/1272
2021/0129956 A1 * 5/2021 Cohen ..... A41F 9/005

* cited by examiner

IMMOBILIZING SLEEP GARMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sleep garment devices and more particularly pertains to a new sleep garment device for immobilizing a user's arm while the user is sleeping. The device includes a vest which has a plurality of mating members each strategically positioned on a chest of the vest. A glove is provided that can be worn on the user's hand. A mating member is attached to the glove and the mating member on the glove is matable to the mating members on the chest of the vest. In this way the user's arm can be restrained while the user is sleeping during recovery of shoulder surgery.

(2) Description of Related Art Including Information Disclosed Under 37 CFR 1.97 and 1.98

The prior art relates to sleep garment devices including a band that is wearable around a user's shoulders and a pair of gloves that are matable to the band for restraining the user's arms during post-surgical recovery. The prior art discloses a waist belt that is wearable around a user's waist and a wrist cuff that is matable to the waist belt for retraining the user's arm during post-surgical recovery. The prior art discloses a post surgical garment that includes a belt strap, an over-the-shoulder strap that is coupled to the belt strap and a wrist cuff that is attachable to the over-the-shoulder strap for immobilizing a user's arm. The prior art discloses a post surgical garment that includes a vest, a pair of loops each integrated into the vest and a pair of wrist cuffs that are extendable through respective loops for immobilizing a user's arms. The prior art discloses an immobilizing garment that includes a shirt and a plurality of loops each integrated into the shirt which can receive fingers on the user's hands for immobilizing the user's hands.

BRIEF SUMMARY OF THE INVENTION

An embodiment of the disclosure meets the needs presented above by generally comprising a vest is wearable on a user when the user is recovering from shoulder surgery. A plurality of chest mating members is each vertically oriented on the vest. A plurality of first straps is each disposed on the vest and a plurality of second straps is each of the second straps is disposed on the vest. Each of the first straps is releasably matable to a respective one of the second straps to secure the vest around the user's upper torso. A glove is provided that can be worn on a respective one of the user's hands. A glove mating member is coupled to the glove and the glove mating member releasably engages the chest mating members at a desired location on the plurality of chest mating members to restrain the user's arm for sleeping while recovering from the shoulder or arm surgery.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
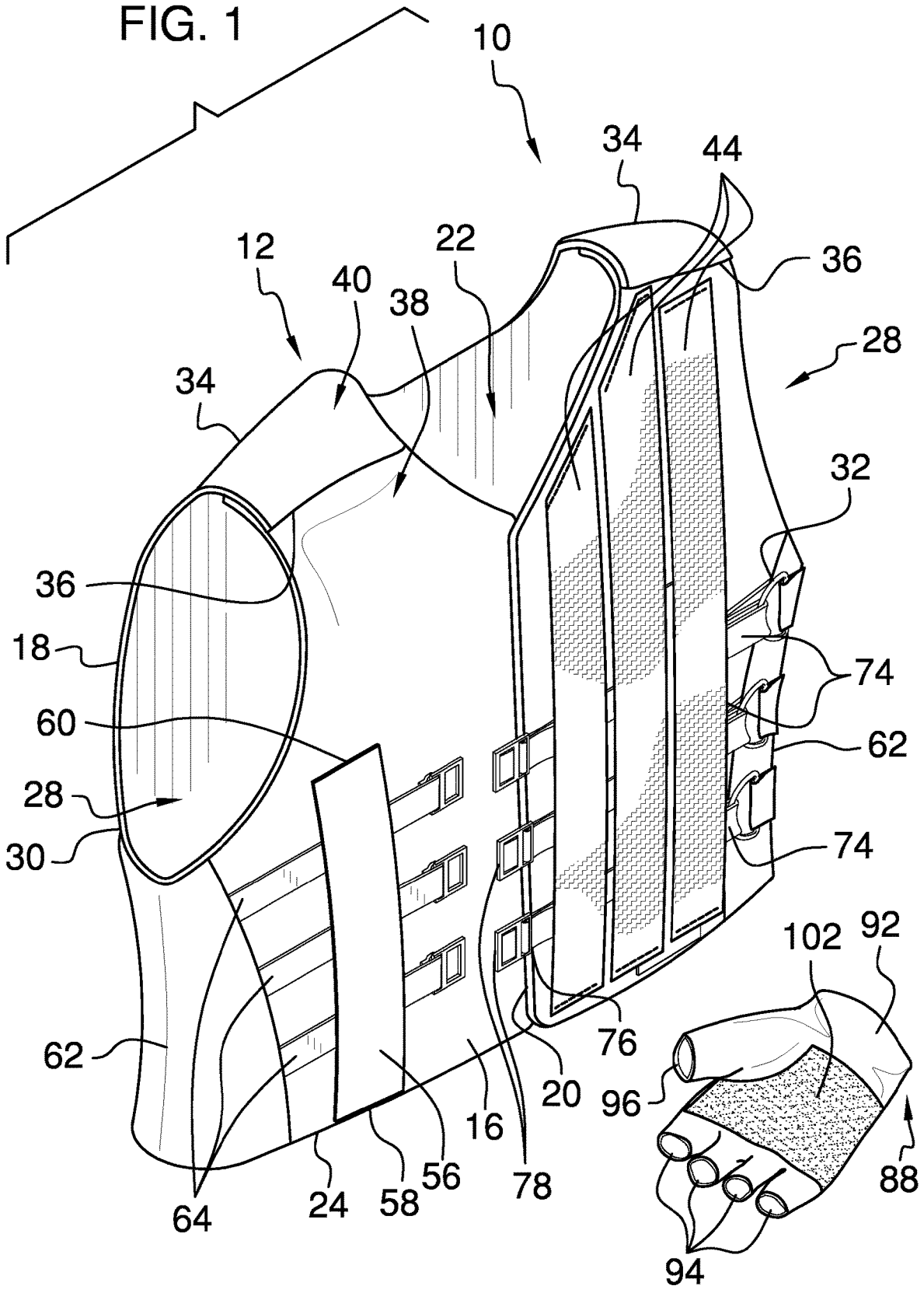
FIG. 1 is a front perspective view of an immobilizing sleep garment assembly according to an embodiment of the disclosure.
Figure 2:
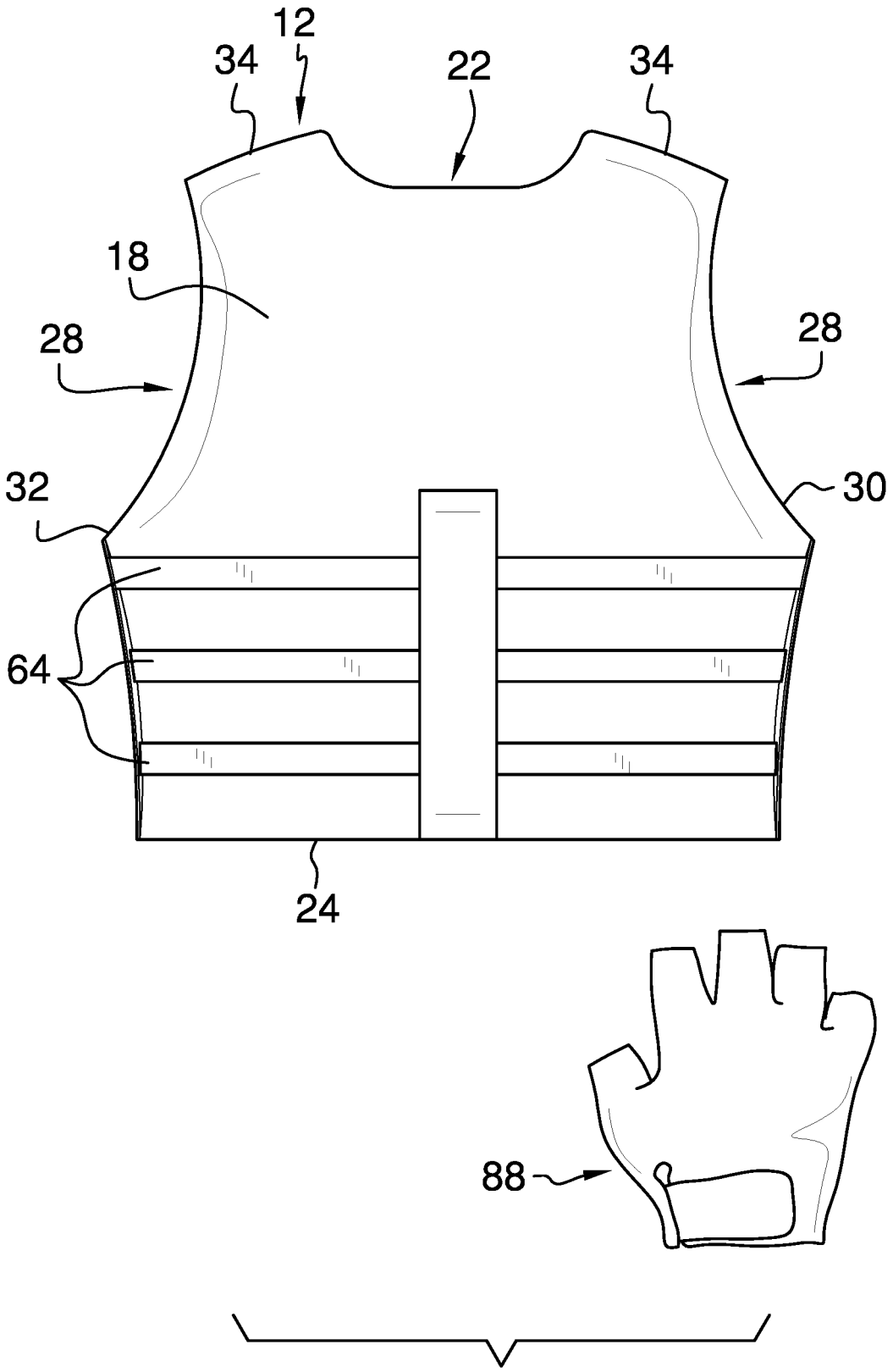
FIG. 2 is a back view of an embodiment of the disclosure.
Figure 3:
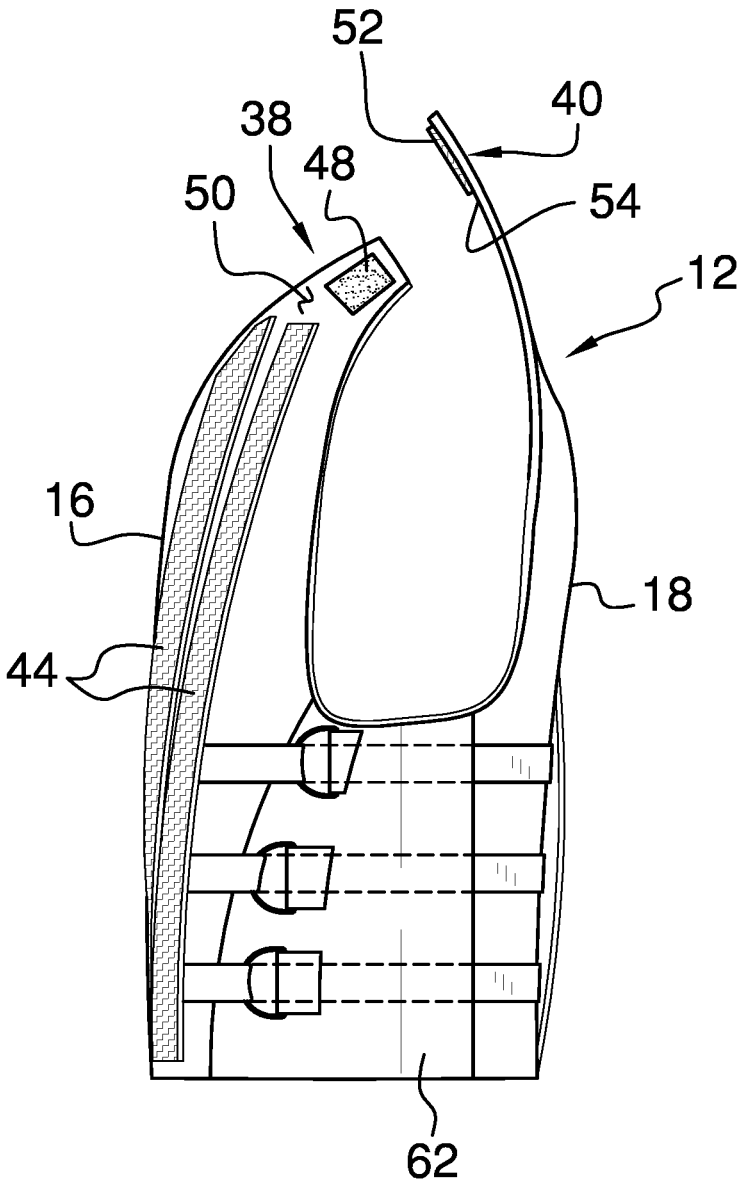
FIG. 3 is a left side view of a vest of an embodiment of the disclosure.
Figure 4:
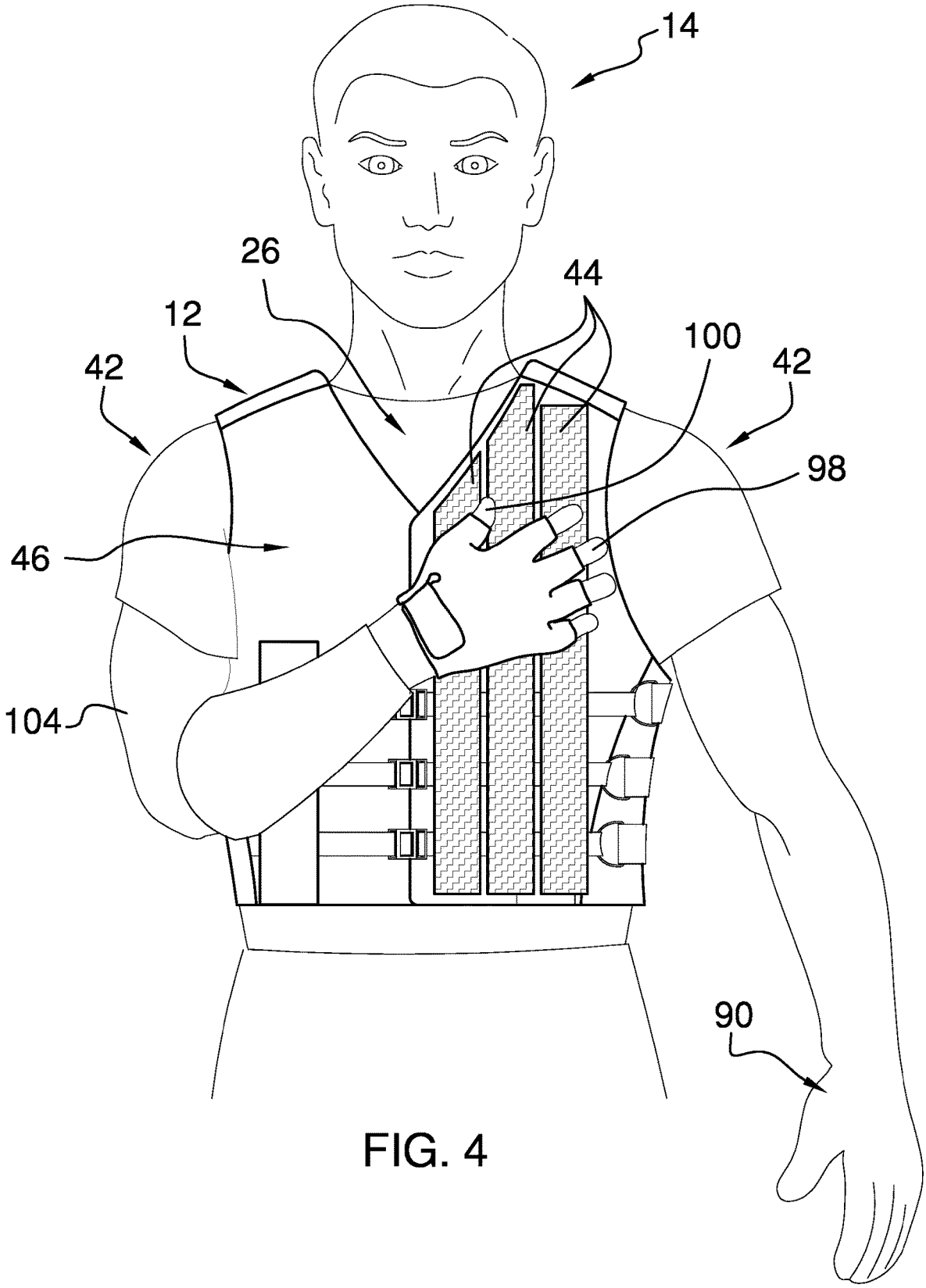
FIG. 4 is a perspective in-use view of an embodiment of the disclosure.
Figure 5:
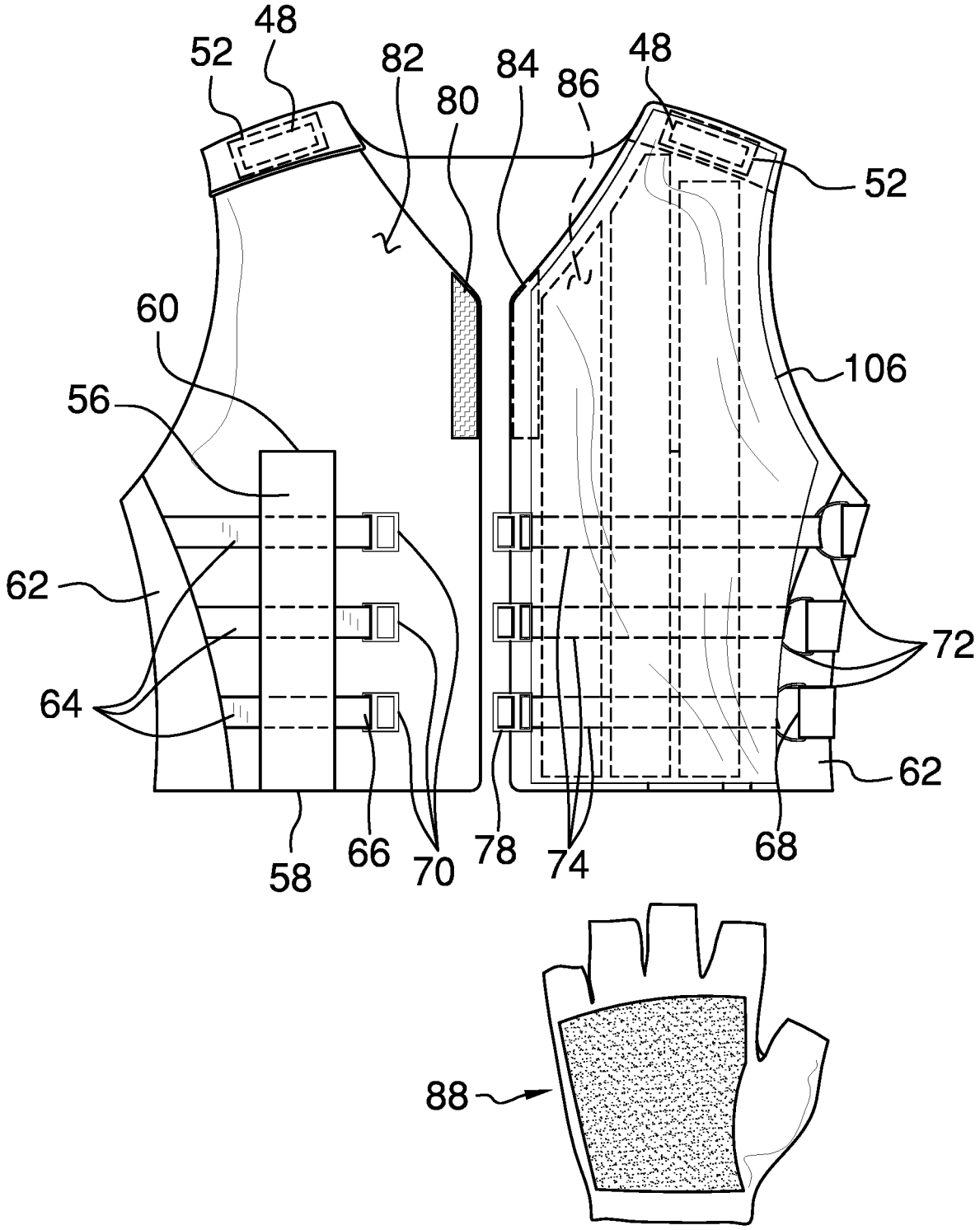
FIG. 5 is a front phantom view of an embodiment of the disclosure.

With reference now to the drawings, and in particular to FIGS. 1 through 5 thereof, a new sleep garment device embodying the principles and concepts of an embodiment of the disclosure and generally designated by the reference numeral 10 will be described.

As best illustrated in FIGS. 1 through 5, the immobilizing sleep garment assembly 10 generally comprises a vest 12 that can be worn on a user 14 when the user 14 is recovering from shoulder or arm surgery. The vest 12 has a front side 16 and a back side 18, and the front side 16 has a cut 20 extending between a neck opening 22 and a waist 24 of the vest 12 to facilitate the vest 12 to be worn around the user's upper torso 26. The vest 12 has a pair of arm openings 28 each extending through a respective first lateral side 30 and a second lateral side 32 of the vest 12. Additionally, the vest 12 has a pair of shoulders 34 each extending between the front side 16 and the back side 18. Each of the shoulders 34 has a cut 36 extending between a respective arm opening 28 and the neck opening 22 to define a first portion 38 and a second portion 40 of each of the shoulders 34. The first portion 38 and the second portion 40 of a respective one of the shoulders 34 is releasably matable to each other. In this way each of the shoulders 34 of the vest 12 is adjustable to accommodate the size of the user's shoulders 42.

A plurality of chest mating members 44 is provided and each of the chest mating members 44 is vertically oriented on the vest 12. Each of the chest mating members 44 is positioned on the front side 16 of the vest 12 such that each of the chest mating members 44 is positioned on the user's chest 46 when the vest 12 is worn. Each of the chest mating members 44 extends substantially between the waist 24 and the first portion 38 of a respective one of the shoulders 34. The chest mating members 44 are spaced apart from each other and are distributed between the cut 20 in the front side 16 of the vest 12 and the second lateral side 32 of the vest 12. Each of the chest mating members 44 may comprise a hook portion of a hook and loop fastener or other type of multiple use, releasable fastener.

A pair of first shoulder mating members 48 is provided and each of the first shoulder mating members 48 is coupled to the vest 12. Each of the first shoulder mating members 48 is positioned on an outside surface 50 of the first portion 38 of a respective one of the shoulders 34. Furthermore, each of the first shoulder mating members 48 is positioned adjacent to the cut 36 in the respective shoulder 34. A pair of second shoulder mating members 52 is each coupled to the vest 12. Each of the second shoulder mating members 52 is positioned on an inside surface 54 of the second portion 40 of a respective one of the shoulders 34. Additionally, each of the first shoulder mating members 48 is positioned adjacent to the cut 36 in the respective shoulder 34. Each of the second shoulder mating members 52 is matable to a respective one of the first shoulder mating members 48. In this way each of the first shoulder mating members 48 and each of the second shoulder mating members 52 can secure each of the shoulders 34 of the vest 12 over the user's shoulders 42.

A band 56 is provided that has a first end 58 and a second end 60, and each of the first end 58 and the second end 60 is coupled to the front side 16 of the vest 12. The band 56 is oriented to extend partially between the waist 24 and a respective one of the shoulders 34. A pair of side panels 62 is provided and each of the side panels 62 is positioned on a respective one of the first lateral side 30 and the second lateral side 32 of the vest 12. Each of the side panels 62 extends between the waist 24 and a respective one of the arm openings 28. A plurality of first straps 64 is each disposed on the vest 12 and each of the first straps 64 extends substantially around the vest 12. In this way each of the first straps 64 extends partially around the user's upper torso 26 when the vest 12 is worn.

Each of the first straps 64 has a primary end 66 and a secondary end 68, and each of the first straps 64 is horizontally oriented on the vest 12. The first straps 64 are spaced apart from each other and are distributed upwardly from the waist 24. Each of the first straps 64 extends beneath the band 56 on the front side 16 of the vest 12 such that the primary end 66 of each of the first straps 64 is positioned on the front side 16 of the vest 12 at a point that is located adjacent to the cut 20 in the front side 16 of the vest 12. Each of the first straps 64 extends beneath each of the side panels 62 on the vest 12.

A plurality of first strap couplers 70 is provided and each of the first strap couplers 70 is coupled to the primary end 66 of a respective one of the first straps 64. A plurality of rings 72 is provided and each of the rings 72 is disposed on the secondary end 68 of a respective one of the first straps 64. A plurality of second straps 74 is each disposed on the vest 12 and each of the second straps 74 extends partially across the front side 16 of the vest 12. Each of the second straps 74 extends through a respective one of the rings 72 on the secondary end 68 of the first straps 64 thereby facilitating a length of each of the second straps 74 to be adjusted.

Each of the second straps 74 has a distal end 76 with respect to the respective ring 72. Each of the second straps 74 extends beneath each of the chest mating members 44 such that the distal end 76 of each of the second straps 74 is positioned adjacent to the cut 20 in the front side 16 of the vest 12. A plurality of second strap couplers 78 is each coupled to the distal end of a respective one of the second straps 74. Each of the second strap couplers 78 releasably engages a respective one of the first strap couplers 70. In this way each of the first straps 64 and each of second straps 74 can secure the vest 12 around the user's upper torso 26. Each of the first strap couplers 70 and each of the second strap couplers 78 may comprise complementary buckles that can be attached to each other and released from each other using only one hand.

A first closure mating member 80 is coupled to an outside surface 82 of the front side 16 of the vest 12. The first closure mating member 80 is positioned adjacent to the cut 20 in the front side 16. A second closure mating member 84 is coupled to an inside surface 86 of the front side 16 of the vest 12 and the second closure mating member 84 is positioned adjacent to the cut 20 in the front side 16. The second closure mating member 84 releasably engages the first closure mating member 80 to secure the vest 12 around the user's upper torso 26. Each of the first closure mating member 80 and the second closure mating member 84 may comprise complementary portions of a hook and loop fastener or the like.

A glove 88 is provided that can be worn on a respective one of the user's hands 90, and the glove 88 has a palm 92, a plurality of fingers 94 and a thumb 96. Each of the fingers 94 is open to facilitate a respective one of the user's fingers 98 to extend outwardly through a respective one of the fingers 94 on the glove 88 when the glove 88 is worn. The thumb 96 is open to facilitate the user's thumb 100 to extend outwardly through the thumb 96 on the glove 88 when the glove 88 is worn. A glove mating member 102 is coupled to the glove 88 and the glove mating member 102 releasably engaging the chest mating members 44 at a desired location on the plurality of chest mating members 44. In this way the glove 88 restrains the user's arm 104 for sleeping while the user 14 is recovering from the shoulder or arm surgery. Additionally, the glove mating member 102 is positioned on the palm 92 of the glove 88, and the glove mating member 102 may comprise a loop portion of a hook and loop fastener or other type of releasable, multiple use fastener. As is most clearly shown in FIG. 5, a cover 106 may be provided that can be positioned over each of the chest mating members 44 to conceal the chest mating members 44.

In use, the vest 12 is worn on the user 14 and each of the shoulders 34 of the vest 12 is secured over each of the user's shoulders 42 at a desired tightness. Additionally, each of the first strap couplers 70 is attached to a respective one of the second strap couplers 78 to secure the vest 12 around the user's upper torso 26. The glove 88 is worn on a respective one of the user's hands 90 and the glove mating member 102 is secured to the chest mating members 44 at a desired location on the vest 12. In this way the user's arm 104 can be restrained thereby facilitating the user 14 to sleep comfortably while the user 14 is recovering from rotator cuff surgery, for example, or other type of surgery that would typically require the user 14 to wear an arm sling.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An immobilizing sleep garment assembly for immobilizing a user's arm while sleeping to enhance post-surgical healing, said assembly comprising:

a vest being configured to be worn on the user when the user is recovering from shoulder or arm surgery;

a plurality of chest mating members, each of said chest mating members being vertically oriented on said vest;

a plurality of first straps, each of said first straps being disposed on said vest, each of said first straps extending substantially around said vest wherein each of said first straps is configured to extend partially around the user's upper torso when said vest is worn;

a plurality of second straps, each of said second straps being disposed on said vest, each of said first straps being releasably matable to a respective one of said second straps wherein each of said first straps and each of second straps is configured to secure said vest around the user's upper torso;

a glove being configured to be worn on a respective one of the user's hands;

a glove mating member being coupled to said glove, said glove mating member releasably engaging said chest mating members at a desired location on said plurality of chest mating members wherein said glove is configured to restrain the user's arm for sleeping while recovering from the shoulder or arm surgery;

wherein said vest has a front side and a back side, said front side having a cut extending between a neck opening and a waist of said vest wherein said cut is configured to facilitate the vest to be worn around the user's upper torso, said vest having a pair of shoulders each extending between said front side and said back side, said vest having a first arm opening and a second arm opening, the first arm opening extending through the first lateral side and the second arm opening extending through the second lateral side of said vest, each of said shoulders having a cut extending between a respective one of the arm openings and said neck opening to define a first portion and a second portion of each of said shoulders, said first portion and said second portion of a respective one of said shoulders being releasably matable to each other wherein each of said shoulders is configured to be adjustable to accommodate the size of the user's shoulders;

a first closure mating member being coupled to an outside surface of said front side of said vest, said first closure mating member being positioned adjacent to said cut in said front side; and a second closure mating member being coupled to an inside surface of said front side of said vest, said second closure mating member being positioned adjacent to said cut in said front side, said second closure mating member releasably engaging said first closure mating member wherein each of said first closure mating member and said second closure mating member is configured to secure said vest around the user's upper torso.

2. The assembly according to claim 1, wherein each of said chest mating members is positioned on said front side of said vest wherein each of said chest mating members is configured to be positioned on the user's chest when said vest is worn, each of said chest mating members extending substantially between said waist and said first portion of a respective one of said shoulders, said chest mating members being spaced apart from each other and being distributed between said cut in said front side of said vest and said second lateral side of said vest.

3. The assembly according to claim 1, further comprising a pair of first shoulder mating members, each of said first shoulder mating members being coupled to said vest, each of said first shoulder mating members being positioned on said an outside surface of said first portion of a respective one of said shoulders, each of said first shoulder mating members being positioned adjacent to said cut in said respective shoulder.

4. The assembly according to claim 3, further comprising a pair of second shoulder mating members, each of said second shoulder mating members being coupled to said vest, each of said second shoulder mating members being positioned on said an inside surface of said second portion of a respective one of said shoulders, each of said first shoulder mating members being positioned adjacent to said cut in said respective shoulder, each of said second shoulder mating members being matable to a respective one of said first shoulder mating members wherein each of said first shoulder mating members and each of said second shoulder mating members is configured to secure each of said shoulders of said vest over the user's shoulders.

5. The assembly according to claim 1, wherein:

said glove has a palm, a plurality of fingers and a thumb, each of said fingers being open wherein each of said fingers is configured to facilitate a respective one of the user's fingers to extend outwardly through a respective one of said fingers on said glove when said glove is worn, said thumb being open wherein said thumb is configured to facilitate the user's thumb to extend outwardly through said thumb on said glove when said glove is worn; and said glove mating member is positioned on said palm of said glove.

6. An immobilizing sleep garment assembly for immobilizing a user's arm while sleeping to enhance post-surgical healing, said assembly comprising:

a vest being configured to be worn on the user when the user is recovering from shoulder or arm surgery;

a plurality of chest mating members, each of said chest mating members being vertically oriented on said vest;

a plurality of first straps, each of said first straps being disposed on said vest, each of said first straps extending substantially around said vest wherein each of said first straps is configured to extend partially around the user's upper torso when said vest is worn;

a plurality of second straps, each of said second straps being disposed on said vest, each of said first straps being releasably matable to a respective one of said second straps wherein each of said first straps and each of second straps is configured to secure said vest around the user's upper torso;

a glove being configured to be worn on a respective one of the user's hands;

a glove mating member being coupled to said glove, said glove mating member releasably engaging said chest mating members at a desired location on said plurality of chest mating members wherein said glove is configured to restrain the user's arm for sleeping while recovering from the shoulder or arm surgery;

wherein said vest has a front side and a back side, said front side having a cut extending between a neck opening and a waist of said vest wherein said cut is configured to facilitate the vest to be worn around the user's upper torso, said vest having a pair of shoulders each extending between said front side and said back side, said vest having a first arm opening and a second arm opening, the first arm opening extending through the first lateral side and the second arm opening extending through the second lateral side of said vest, each of said shoulders having a cut extending between a respective one of the arm openings and said neck opening to define a first portion and a second portion of each of said shoulders, said first portion and said second portion of a respective one of said shoulders being releasably matable to each other wherein each of said shoulders is configured to be adjustable to accommodate the size of the user's shoulders;

wherein said assembly includes a band having a first end and a second end, each of said first end and said second end being coupled to said front side of said vest, said band being oriented to extend partially between said waist and a respective one of said shoulders;

wherein said assembly includes a pair of side panels, each of said side panels being positioned on a respective one of said first lateral side and said second lateral side of said vest, each of said side panels extending between said waist and a respective one of said shoulder openings; and wherein each of said first straps has a primary end and a secondary end, each of said first straps being horizontally oriented on said vest, said plurality of first straps being spaced apart from each other and being distributed upwardly from said waist, each of said first straps extending beneath said band on said front side of said vest such that said primary end of each of said first straps is positioned on said front side of said vest at a point being located adjacent to said cut in said front side of said vest, each of said first straps extending beneath each of said side panels on said vest.

7. The assembly according to claim 6, wherein:

said assembly includes a plurality of rings, each of said rings being disposed on said secondary end of a respective one of said first straps; and each of said second straps extends through a respective one of said rings on said secondary end of said first straps thereby facilitating a length of each of said second straps to be adjusted, each of said second straps having a distal end with respect to said respective ring, each of said second straps extending beneath each of said chest mating members such that said distal end of each of said second straps is positioned adjacent to said cut in said front side of said vest.

8. The assembly according to claim 7, further comprising:

said assembly includes a plurality of first strap couplers, each of said first strap couplers being coupled to said primary end of a respective one of said first straps; and a plurality of second strap couplers, each of said second strap couplers being coupled to said distal end of a respective one of said second straps, each of said second strap couplers releasably engaging a respective one of said first strap couplers wherein each of said first straps and each of second straps is configured to secure said vest around the user's upper torso.

9. An immobilizing sleep garment assembly for immobilizing a user's arm while sleeping to enhance post-surgical healing, said assembly comprising:

a vest being configured to be worn on the user when the user is recovering from shoulder or arm surgery, said vest having a front side and a back side, said front side having a cut extending between a neck opening and a waist of said vest wherein said cut is configured to facilitate the vest to be worn around the user's upper torso, said vest having a pair of shoulders each extending between said front side and said back side, said vest having a first arm opening and a second pair of arm opening, the vest further having a first lateral side and a second lateral side, the first arm opening extending through the first lateral side and the second arm opening extending through the second lateral side of said vest, each of said shoulders having a cut extending between a respective shoulder one of the arm openings and said neck opening to define a first portion and a second portion of each of said shoulders, said first portion and said second portion of a respective one of said shoulders being releasably matable to each other wherein each of said shoulders is configured to be adjustable to accommodate the size of the user's shoulders;

a plurality of chest mating members, each of said chest mating members being vertically oriented on said vest, each of said chest mating members being positioned on said front side of said vest wherein each of said chest mating members is configured to be positioned on the user's chest when said vest is worn, each of said chest mating members extending substantially between said waist and said first portion of a respective one of said shoulders, said chest mating members being spaced apart from each other and being distributed between said cut in said front side of said vest and said second lateral side of said vest;

a pair of first shoulder mating members, each of said first shoulder mating members being coupled to said vest, each of said first shoulder mating members being positioned on said an outside surface of said first portion of a respective one of said shoulders, each of said first shoulder mating members being positioned adjacent to said cut in said respective shoulder;

a pair of second shoulder mating members, each of said second shoulder mating members being coupled to said vest, each of said second shoulder mating members being positioned on said an inside surface of said second portion of a respective one of said shoulders, each of said first shoulder mating members being positioned adjacent to said cut in said respective shoulder, each of said second shoulder mating members being matable to a respective one of said first shoulder mating members wherein each of said first shoulder mating members and each of said second shoulder mating members is configured to secure each of said shoulders of said vest over the user's shoulders;

a band having a first end and a second end, each of said first end and said second end being coupled to said front side of said vest, said band being oriented to extend partially between said waist and a respective one of said shoulders;

a pair of side panels, each of said side panels being positioned on a respective one of said first lateral side and said second lateral side of said vest, each of said side panels extending between said waist and a respective one of said shoulder openings;

a plurality of first straps, each of said first straps being disposed on said vest, each of said first straps extending substantially around said vest wherein each of said first straps is configured to extend partially around the user's upper torso when said vest is worn, each of said first straps having a primary end and a secondary end, each of said first straps being horizontally oriented on said vest, said plurality of first straps being spaced apart from each other and being distributed upwardly from said waist, each of said first straps extending beneath said band on said front side of said vest such that said primary end of each of said first straps is positioned on said front side of said vest at a point being located adjacent to said cut in said front side of said vest, each of said first straps extending beneath each of said side panels on said vest;

a plurality of first strap couplers, each of said first strap couplers being coupled to said primary end of a respective one of said first straps;

a plurality of rings, each of said rings being disposed on said secondary end of a respective one of said first straps;

a plurality of second straps, each of said second straps being disposed on said vest, each of said second straps extending partially across said front side of said vest, each of said second straps extending through a respective one of said rings on said secondary end of said first straps thereby facilitating a length of each of said second straps to be adjusted, each of said second straps having a distal end with respect to said respective ring, each of said second straps extending beneath each of said chest mating members such that said distal end of each of said second straps is positioned adjacent to said cut in said front side of said vest;

a plurality of second strap couplers, each of said second strap couplers being coupled to said distal end of a respective one of said second straps, each of said second strap couplers releasably engaging a respective one of said first strap couplers wherein each of said first straps and each of second straps is configured to secure said vest around the user's upper torso;

a first closure mating member being coupled to an outside surface of said front side of said vest, said first closure mating member being positioned adjacent to said cut in said front side;

a second closure mating member being coupled to an inside surface of said front side of said vest, said second closure mating member being positioned adjacent to said cut in said front side, said second closure mating member releasably engaging said first closure mating member wherein each of said first closure mating member and said second closure mating member is configured to secure said vest around the user's upper torso;

a glove being configured to be worn on a respective one of the user's hands, said glove having a palm, a plurality of fingers and a thumb, each of said fingers being open wherein each of said fingers is configured to facilitate a respective one of the user's fingers to extend outwardly through a respective one of said fingers on said glove when said glove is worn, said thumb being open wherein said thumb is configured to facilitate the user's thumb to extend outwardly through said thumb on said glove when said glove is worn; and a glove mating member being coupled to said glove, said glove mating member releasably engaging said chest mating members at a desired location on said plurality of chest mating members wherein said glove is configured to restrain the user's arm for sleeping while recovering from the shoulder or arm surgery, said glove mating member being positioned on said palm of said glove.

* * * * *